United States Patent [19]

Graillat et al.

[11] Patent Number: 4,557,061

[45] Date of Patent: Dec. 10, 1985

[54] ALPINE SKI BOOT

[75] Inventors: Gerard Graillat, Annecy; Michel Mabboux, Seynod, both of France

[73] Assignee: Salomon S.A., Annecy, France

[21] Appl. No.: 435,287

[22] Filed: Oct. 19, 1982

[30] Foreign Application Priority Data

Oct. 19, 1981 [FR] France ..... 81 19997

[51] Int. Cl.[4] ..... A43B 5/04

[52] U.S. Cl. ..... 36/119

[58] Field of Search ..... 36/117–121, 36/105

[56] References Cited

U.S. PATENT DOCUMENTS

| | | | |
|---|---|---|---|
| 3,883,964 | 5/1975 | Check . | |
| 4,160,332 | 7/1979 | Salomon | 36/119 |
| 4,196,530 | 4/1980 | Delery | 36/119 |
| 4,205,467 | 6/1980 | Salomon | 36/119 |
| 4,382,342 | 5/1983 | Spademan | 36/119 |
| 4,449,274 | 5/1984 | Balbinot | 36/117 X |

FOREIGN PATENT DOCUMENTS

| | | | |
|---|---|---|---|
| 1802710 | 5/1970 | Fed. Rep. of Germany | 36/119 |
| 1816811 | 6/1970 | Fed. Rep. of Germany . | |
| 2907163 | 8/1980 | Fed. Rep. of Germany . | |
| 2381483 | 9/1978 | France | 36/119 |
| 2416660 | 9/1979 | France . | |

*Primary Examiner*—James Kee Chi

*Attorney, Agent, or Firm*—Sandler & Greenblum

[57] ABSTRACT

According to the invention a boot is provided which includes a shell base having an inner sole mounted therein. Additionally, the boot includes a foot retention system positioned within the shell base; the foot retention system including at least one support element positioned between the shell base and the area in which a foot is to be inserted. The support element is adapted to at least partially cover the foot. An adjustable tightening apparatus serves to tighten the support element around the foot. The tightening apparatus includes pressurization means for pressing the support element against the foot and adjustment means for adjusting the pressurization means. The boot apparatus is such that the pressurization means exerts pressure directly on a front portion of the foot, and extends generally from the inner sole of the boot to the upper portion of the foot.

28 Claims, 6 Drawing Figures

ALPINE SKI BOOT

BACKGROUND OF THE INVENTION

1. Field of the Invention

The invention relates to a ski boot comprising a rigid shell and at least one foot retention system positioned within the shell.

2. Description of Prior Art

Various embodiments of boots comprising a foot retention system have previously been developed. In particular, ski boots are known which are provided with a rigid plate positioned between the shell and an interior shoe. The plate is pressed vertically against the shoe by screws implanted in the upper portion of the shell base so as to retain the foot as is described in U.S. Pat. No. 3,883,964.

Likewise, ski boots are known whose foot retention system is of the type claimed in French Pat. No. 2,343,437, filed by Applicant, the disclosure of which is hereby incorporated by reference, which incorporates straps surrounding the foot and attached to the shell at each side thereof.

Furthermore, a ski boot is known whose foot retention is assured by a strap positioned perpendicularly to the axis of the boot which exerts a vertical force on the foot when it is place in tension by a strap buckle apparatus as is described in German Patent DE No. 18 16 811.

Finally, other foot retention systems are known for retaining the foot within the shell which are more particularly adapted to ski boots of the type which open in front. In these systems one utilizes the deformation properties of the walls to maintain the foot within the shell.

For the different types of boots described, the foot retention systems which are provided therein suffer from a certain number of disadvantages.

Particularly, for boots of the type which open to the rear such as are illustrated in U.S. Pat. No. 3,883,964 and German Patent DE No. 18 16 811, there is a relatively localized retention of the foot at the upper portion of the foot which is then vertically crushed without having any lateral retention, while in French Pat. No. 2 343 437, the retention of the foot in the boot is obtained by its maintenance on the inner sole by means of a set of straps whose assembly complexity increases the cost of such a boot.

With respect to boots of the type which open to the front, it appears that the deformation of the walls of the shell by strap systems attached to the interior of the shell and extending to the exterior thereof so that they can be tightened by means of a strap buckle, is not sufficient to provide the tightening and the necessary maintenance of the foot.

SUMMARY OF THE INVENTION

It is an object of the present invention to provide a boot, particularly a ski boot of the type comprising a foot retention system which simultaneously assures good vertical and lateral holding of the foot, as well as a positioning of the foot (surrounded by the slipper) in contact with at least one lateral wall of the shell so as to improve the feeling of contact with the boot, and to thus increase the steering precision of the skis by improving the possibilities of canting during the practice of skiing.

According to the invention a boot is provided which comprises a shell base having an inner sole mounted therein. Additionally, the boot includes a foot retention system positioned within the shell base; the foot retention system comprising at least one support element positioned between the shell base and the area in which a foot is to be inserted. The support element is adapted to at least partially cover the foot. An adjustable tightening apparatus serves to tighten the support element around the foot. The tightening apparatus comprises pressurization means for pressing the support element against the foot and adjustment means for adjusting the pressurization means. The boot apparatus is such that the pressurization means exerts pressure directly on a front portion of the foot, and extends generally from the inner sole of the boot to the upper portion of the foot.

According to a most preferred embodiment of the invention, the boot is a ski boot, and the shell base is made of a rigid material. Nevertheless, the boot may be another kind of boot used in sports, and even be a boot used to provide orthopedic correction.

Generally, the pressurization means extends to a position above the foot along the somital line of the foot. The pressurization means may be in the form of a flexible arch, wherein one of the ends of the flexible arch is positioned in the vicinity of one of the lateral edges of the inner sole, while the other end is positioned in the vicinity of the somital line at a location corresponding to the upper portion of the foot. In this embodiment, a cord is defined between the two ends of the pressurization means which is oblique with respect to the plane partially containing one of the lateral walls of the boot. The cord extends transversely to the longitudinal axis of the interior of the shell base.

In one embodiment, one end of the pressurization means may be positioned on the external lateral portion of the boot and the other end of the pressurization means is moveably positioned at a location generally in the vicinity of the somital line of the foot and at the top of the foot, whereby the internal surface of the foot is pressed against the lateral internal wall of the boot.

In an alternative embodiment, the pressurization means is positioned to extend from the internal lateral side wall of the boot to a moveable position at the general vicinity of the somital line of the foot at the top of the foot, whereby the external surface of the foot is pressed against the lateral external wall of the boot.

In both embodiments, as well as others, the pressurization means has its upper end positioned over the top portion of the area in which the foot is to be inserted; the upper end being translationally moveable along a direction generally transverse to the longitudinal axis of the shell base, while the lower end of the pressurization means is fixed along the rim of the inner sole.

Various types of pressurization means are possible within the scope of the invention. By way of example, the pressurization means may comprise a cable, strap, flexible blade, or the like.

In one embodiment, the pressurization means comprises an element which when subjected to compression exerts pressure on the support element. In this embodiment, the pressurization means comprises a wedge of elastic material which, upon compression, exerts force on the support element. The pressurization means may, in this embodiment, be a sack of viscoelastic material.

The adjustment means may comprise a nut with the pressurization means being secured at one of its ends to the nut. The nut is generally positioned above the upper portion of the zone adapted to receive the foot. The adjustment means may further comprise a threaded bolt, the nut being adapted to move translationally along the threaded bolt. The threaded bolt may have a handle attached thereto to permit rotation of the bolt so as to move the nut, thereby tightening or loosening the pressurization means.

In one particular embodiment, the adjustment means comprises a nut and a threaded bolt, and the pressurization means is integral with the bolt at its upper end. The bolt is adapted to move the pressurization means translationally along the threaded bolt. Again the threaded bolt may have a handle attached thereto to permit rotation of the bolt to move the nut, thereby tightening or loosening the pressurization means.

The pressurization means itself may comprise a traction cable forming an uninterrupted stirrup around the upper portion of the foot; the cable being adapted t be tightened or loosened, by the adjustment means. The stirrup extends from the rear lower portion of the shell base upwardly around the instep portion of the boot. The stirrup extends over the exterior portion of the shell over a portion of its circumference and extends directly on the support element over the remaining portion of its circumference. In this embodiment, the shell base comprises openings provided on each of the lateral sides of the boot at points situated at different heights of the boot. The openings are positioned to allow for the stirrup to come in direct contact with the support element while otherwise the stirrup extends over the exterior portion of the shell base over the remaining portions of its circumference. The stirrup may be associated with adjustment means comprising a latching mechanism adapted to tighten or loosen the force exerted by the stirrup on the support element. The stirrup directly contacts the support element to exert pressure thereon, while otherwise extending over the exterior portion of the shell base.

The support element acts as a distribution plate adapted to distribute the force exerted by the pressurization means on the foot.

BRIEF DESCRIPTION OF THE DRAWINGS

The invention will now be described in detail by way of non-limiting reference to the boot embodiments according to the invention shown in the annexed drawings in which.

DESCRIPTION OF PREFERRED EMBODIMENTS

Figure 1:
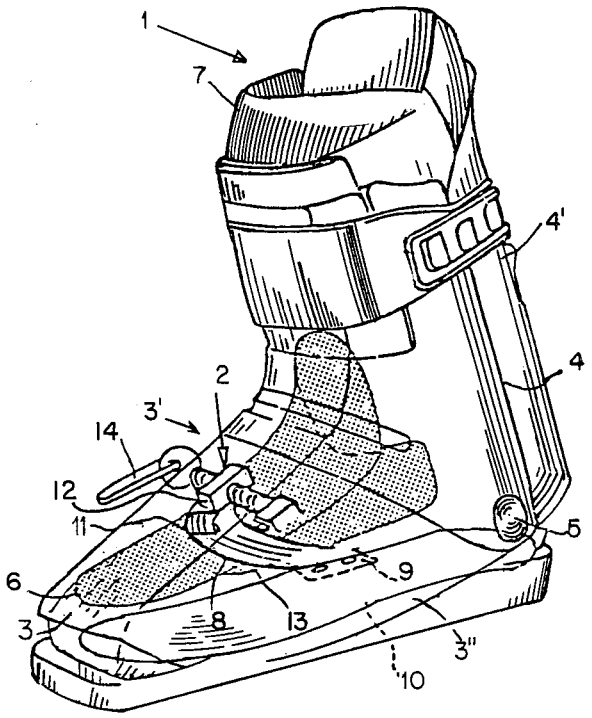
FIG. 1 is a perspective view of one embodiment of the invention applied to the retention of the front portion of the foot of a skier.

According to a preferred embodiment of the invention, the boot according to the invention comprises a rigid shell and a foot retention system positioned within the rigid shell. The foot retention system itself comprises at least one support element positioned between the shell and the foot of the skier. The support element partially surrounds the foot of the skier. The apparatus further includes an adjustable tightening apparatus for tightening the support element. The adjustable tightening apparatus includes pressurization means for pressurizing the support element on the foot as well as control means which may or may not be positioned on the exterior of the shell for tightening the pressurization means. The boot is characterized in that the pressurization means of the support element generally forms, at rest, a flexible arch, one of whose ends is positioned respectively in the vicinity of one of the lateral edges of the inner sole of the rigid shell, while the other end is positioned in the vicinity of the somital line of the top of the foot of the skier. The ends define an oblique cord with respect to the plane partially containing one of the lateral walls of the boot while extending transversally to the longitudinal axis of the interior of the rigid shell.

The solution provided by the present invention furthermore has the advantage of being extremely simple while providing optimal foot retention effectiveness. Furthermore, the simplicity of the design of such foot retention systems reduces the cost of manufacture of boots incorporating the systems while providing elevated functional reliability.

The foot of the skier is positioned such that it is simultaneously squeezed against the inner sole of the boot and against at least one of the lateral walls of the shell. This provides a lateral maintenance of the foot and a good feeling of contact with the boot. In effect, during the tightening of the pressurization means by means of the control element, the lateral wall and inner sole tend to come towards the oblique cord defined by the ends of the pressurization means. There occurs, therefore, a tightening dihedral is formed on the one hand by the plane of the inner sole and on the other hand by the plane containing the oblique cord. This tightening dihedral is thus applied on one of the sides of the foot to press the other side of the foot against the plane of the corresponding lateral side of the boot. Finally, the support element has an anatomical form corresponding to that of the top of the foot such that the forces applied by the pressurization means are uniformally distributed over the entire upper surface of the foot.

Different embodiments of the present invention are possible depending upon whether or not they are more particularly directed to the foot front portion or the instep of the skier. For example, it is preferable for a retention system holding the front of the foot to provide the boot with pressurization means of the support element made of an inelastic strap. The pressurization means could also take the form of a traction cable to assure retention of the instep. Finally, other possibilities are also possible where the pressurization means are formed of pressure elements which can be, for example, a plate made of plastic material shaped to conform to the top of the foot and movable in a manner of a tightening corner against the shell and one of the lateral half-portions of the top of the foot.

Likewise, according to another embodiment of the invention, the adjustable tightening apparatus optionally comprises control means which are either nut-bolt systems, manipulation cams, buckle strap systems, etc.

FIG. 1 illustrates a ski boot 1 having a foot retention system 2 according to the invention. The boot is composed of a shell base 3 closed over the front of the foot and an upper 4 which is at least partially journalled. The rear portion 4' of the upper 4 pivots around an axis 5 positioned approximately at the height of the malleoli of the skier and allows for the booting and removal of the boot through the rear of the boot. The foot retention system 2 is shown, for ease of description, in the drawing, by thicker lines than the rest of the boot. The foot retention system is positioned on the interior of the rigid shell 3 generally in a zone corresponding to the lateral external surface of the upper portion of the foot. The system comprises a support element or distribution plate 6 for distributing the tightening forces on the foot which covers, according to a preferred embodiment, the entire upper portion of the foot as well as its external lateral side. Distribution plate 6 is interposed between shell 3 and the external slipper walls 7. An adjustable tightening apparatus acting on the plate 6 is composed of a combination of a nut bolt system and a strap 8 which is flexible and inelastic. This strap is attached at its lower end 9 to inner sole 10. Inner sole 10 is itself integral with shell base 3 of the boot. The attachment zone of the lower end 9 of strap 8 is situated on the external lateral side 3' of the boot while the upper end 11 is connected to control means constituted by a nut 12 moving along a bolt 13 positioned to move transversely to the longitudinal axis in the upper portion of the internal volume of shell base 3. Bolt 13 is rotatably movable from the exterior of the shell by a manipulation element or handle 14 positioned on the external side 3' of the boot. During rotation of bolt 13 to affect tightening, screw 12 is moved along the internal side 3 double prime of the boot and strap 8 to form an arc which tends to come closer to the cord defined by its lower end 9 and upper end 11, this latter being displaced with screw 12 to which it is connected. By this action, the foot is simultaneously pressed on the inner sole 10 and against the lateral internal wall 3 double prime of the boot which thus provides a good retention and a good feeling of contact between the foot and the boot.

Figure 2:
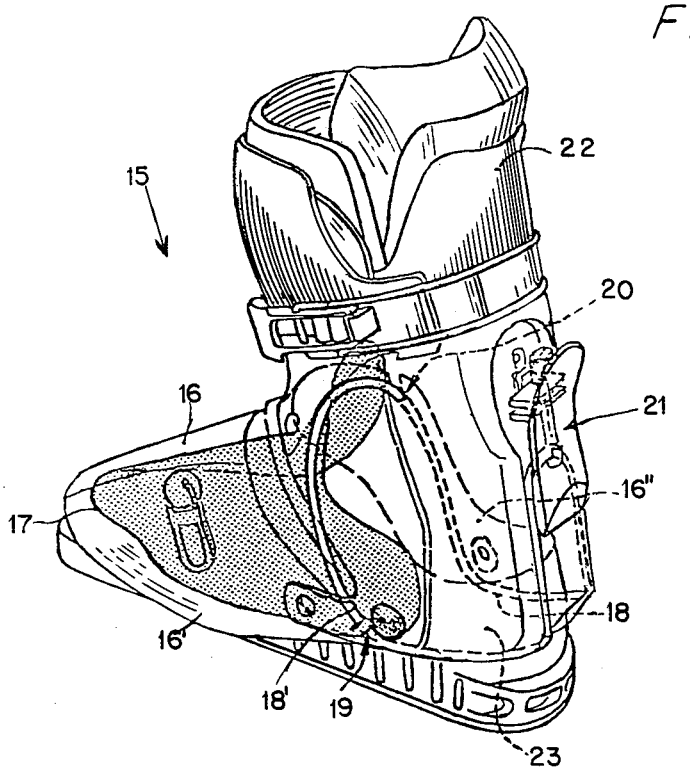
FIG. 2 is a perspective view of an embodiment according to the invention for the retention of the instep of a skier.

FIG. 2 illustrates an embodiment of a boot according to the invention whose retention system is more particularly adapted for the retention of the instep in the boot. Boot 15 is similar to that which has been described above in connection with FIG. 2 and comprises a foot retention system which is still disposed within a rigid shell 16 adapted for rear booting and unbooting of upper 22. This retention system of the foot acts substantially on the upper zone of the foot by means of a distribution plate 17 which is similar to that which was previously described, and which is subjected to the effects of an adjustable tightening apparatus. This latter is composed in this embodiment of a traction cable 18 forming a buckle 18' around the instep which is partially covered at least by distribution plate 17. Buckle 18' extends outside of the walls 16", of shell base 16 respectively through a first opening 19 provided approximately at the level of the journal axis positioned on the lateral external surface 16' of the boot and through a second opening 20 on the lateral internal surface 16" positioned in the zone corresponding to the instep near the apex of the shell base. Cable 18 thus extends the length of the base of the upper of the boot in guides provided for this purpose and is connected to control means 21 positioned to the rear of upper 22 and all of whose elements are positioned to the exterior of the walls of the boot. According to the objectives of the invention, the foot of the skier is thus positioned in a perfectly blocked and held manner at the end of the boot. The heel is maintained simultaneously in the trihedral formed by inner sole 23, internal lateral wall 16" and the rear of upper 22. In this Figure it should be noted that the cable act in the manner previously described for the strap, i.e., it tends to approach the cord defined by passage openings 19 and 20 positioned along a sort of diagonal across the width of the shell, as the cable is tightened. It should be noted that in this embodiment the upper end of the flexible arc constituted by the buckle portion in the shell base is fixed with respect to the lower end situated in the vicinity of the lateral external edge of the inner sole.

Figure 3:
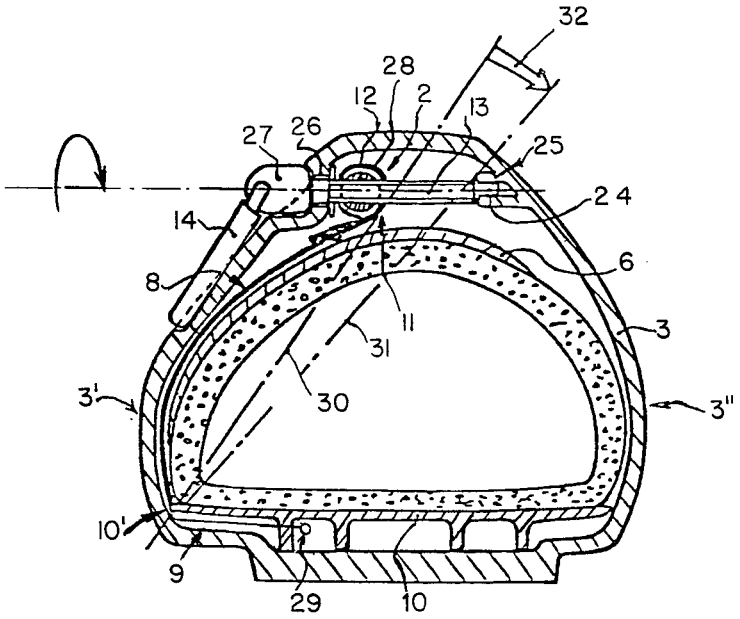
FIG. 3 is a cross-sectional view at the level of the portion at the front of the foot of a boot illustrating foot retention system according to the invention of FIG. 1 in detail.

The cross sectional view shown in FIG. 3 illustrates foot retention system 2 according to the invention in greater detail and relates also, as has been explained with reference to FIG. 1, to an application for the retention of the front of the foot. In FIG. 3 shell base 3 comprises constructional modifications adapted to facilitate the use of foot retention system 2. Thus, manipulation bolt or screw 13 which is rotatable comprises at one of its ends a swivel pin 24 which is clipped between two bosses 25 on the interior of the shell base while the other end extends through a hole 26 on the other side of the shell and is provided with a ferrule 27 made of plastic material serving as a bearing ring. This ferrule furthermore assures the linkage between manipulation element or handle 14 and screw 13 in a well known manner. Nut 12 moves along bolt 13 which receives latching buckle 28 of strap 8. Strap 8 is connected to shell base 3 through inner sole 10 to which it is attached. Assembly means 29, known in itself, provides for the attachment of the strap at end 9 of the sole and is preferably positioned in the vicinity of the lateral external edge 10' of the sole. Thus, in its free position, flexible strap 8, made of braided synthetic fibers, itself matches the contour of the upper portion of the external lateral side of slipper 7 (FIG. 1) and describes a sort of arch positioned on the external half of the upper portion of the foot. The fixed anchorage point of the strap positioned in the vicinity of edge 10' of the inner sole and the linkage of latching buckle 28 of the strap with nut 12 define an oblique cord 30 with respect to the plane of the inner sole. In the course of movement of bolt 12 towards internal surface 3" prime of the boot, this oblique cord 30 will move to a final position indicated at 31 such that the initial arch formed by strap 8 will stretch and match with the cord in the final position. Arrow 32 thus indicates the possible extent of tightening between the two positions.

Figure 4:
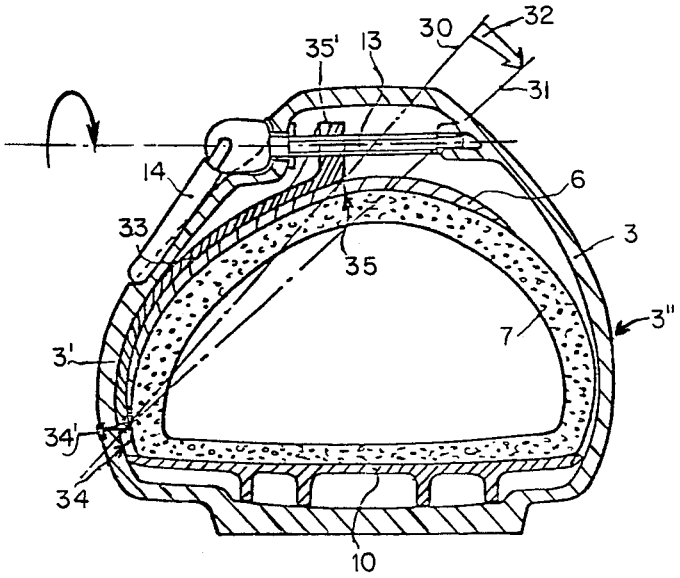
FIG. 4 is a cross-sectional view at the level of the portion at the front of the foot of a boot illustrating another embodiment of a foot retention system according to the invention.

FIG. 4 illustrates an embodiment similar to the preceding embodiment with the only difference that the strap has been replaced by a contoured plate 33 made of relatively flexible plastic material. The operation of this embodiment is indentical to the previous embodiment. Lower end 34 of the plate is attached in the vicinity of edge 10' of the sole to the wall of shell base 3' by conventional assembly means 34' (such as a rivet), while its upper portion 35 comprises an embedded nut 35' assuring linkage with bolt 13.

In the embodiments of FIGS. 3 and 4, the strap, as well as the contoured plate, exerts a force which is approximately perpendicular to the oblique cord. This force is distributed uniformly over the top of the foot by virtue of the support elements which is formed by distribution plate 6. Furthermore, this force can likewise be visualized as being broken down into a vertical component pressing the foot against the sole and a horizontal component simultaneously pressing the foot against the lateral wall of the internal side of the boot.

Figure 5:
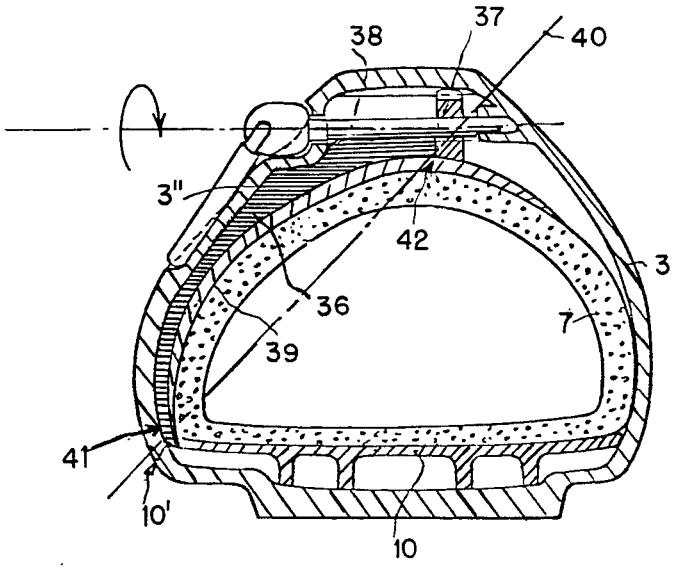
FIG. 5 is a cross-sectional view at the level of the front foot portion of a boot illustrating an embodiment of a foot retention system utilizing elements which press the foot by means of compression of an elastic material.

According to another embodiment illustrated in FIG. 5, the pressurization means of the support element are constituted by a wedge-type element 36 working in compression under the effect of displacement of nut 37 the length of bolt 38. Wedge 36 is made of elastic and deformable material and is wedged between distribution plate 39 and interior wall 3''' of shell base 3. Under the effects of compression, wedge 36 tightening force on the top of the foot. This tightening force is perpendicular to the oblique cord 40 defined by position 42 of nut 37 along the length of bolt 38 and by the lower end 41 of the wedge positioned in the vicinity of edge 10' of internal sole 10. Various configurations of possible wedges exist which can be formed of hard and elastically deformable synthetic foams. Sealed pouches containing either self-casting or fluid materials, or viscoelastic materials may also be provided.

Figure 6:
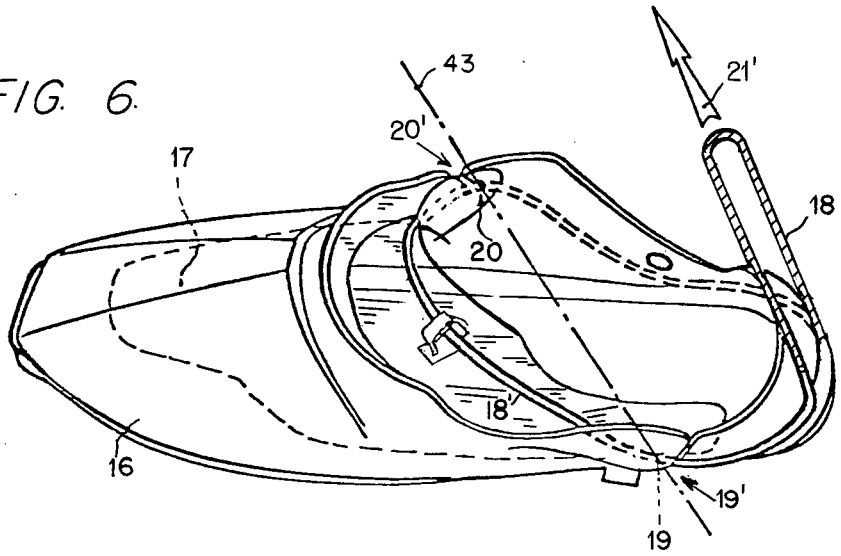
FIG. 6 is a perspective view of a shell base of a boot according to the embodiment of FIG. 2 where the foot retention system is adapted to secure the instep.

FIG. 6 illustrates in perspective view the detail of shell base 16 of boot 15 illustrated in FIG. 2. For purposes of description the shell base is shown exposed, before assembly of the boot upper, such that the path of cable 18 which uses pressurization means of support element 17, appears more clearly in the drawing. Likewise, to simplify the Figure, control element 21 has been schematically shown by arrow 21' indicating the direction of traction exerted by the element on cable 18.

During tightening around the foot in the boot, the skier maneuvers control element 21 constituted, for example, by a lever on which is connected a cable. Buckle 18' formed by the cable stretches over distribution plate 17 which in turn presses on the foot (inserted within the slipper) along a forced direction which is substantially perpendicular to the cord defined by the straight line 43 joining the upper and lower passages 20' and 19', respectively, of cable 18 across the shell base. These upper and lower passage openings define, as a result, respectively, the upper end 20 and lower end 19 of the flexible arch formed by buckle 18'. Of course, in the case of the embodiment shown, this force will be applied towards the rear of the heal and on the internal side of the foot.

The exemplification of various foot retention systems which have been set forth above for maintaining the front of the foot and the instep separately should not be taken to mean that the two effects cannot be combined in a single boot.

Although the various embodiments specifically illustrate foot retention systems which tend to assure contact of the internal lateral surface of the foot with the wall of the internal surface of the boot, the invention is not the be considered as limited to this embodiment and it applies as well to foot retention systems which press the foot against the external lateral wall of the boot. Thus, the use of this system in orthopedic correction boots is very possible.

Furthermore, although the invention has been described with particular reference to ski boots in which insertion occurs through the rear, it is likewise applicable to boots whose opening is in front, and likewise to boots and shoes in other sports.

In summary, although the invention has been described with reference to specific materials, means, embodiments and drawings, it is to be understood that the invention is not limited to the particulars disclosed but extends to all equivalents falling within the scope of the claims.

What is claimed is:

1. A boot comprising:

(a) a shell base having an inner sole mounted therein;

(b) a foot retention system positioned within said shell base, said foot retention system comprising at least one support element positioned between said shell base and the area in which a foot is to be inserted, said support element being adapted to at least partially cover said foot; and (c) an adjustable tightening apparatus for tightening said support element around said foot, said tightening apparatus comprising pressurization means for pressing said support element against the foot and adjustment means for adjusting said pressurization means wherein said pressurization means comprises means for simultaneously pressing said foot against said inner sole and one lateral side of said boot, whereby said pressurization means exerts pressure on a front portion of the foot, said pressurization means extending generally from the inner sole of said boot to the upper portion of the foot.

2. The boot as defined by claim 1 wherein said boot is a ski boot, and wherein said shell base is made of a rigid material.

3. The boot as defined by claim 1 wherein said pressurization means extends to a position above the foot along the somital line of the foot.

4. The boot as defined in claim 1 wherein said pressurization means is in the form of a flexible arch.

5. The boot as defined by claim 4 wherein one of the ends of said flexible arch is positioned in the vicinity of one of the lateral edges of said inner sole, while the other end is positioned in the vicinity of the somital line at a location corresponding to the upper portion of the foot, whereby a cord is defined between the two ends of said pressurization means which is oblique with respect to the plane partially containing one of the lateral walls of the boot, said cord extending transversely to the longitudinal axis of the interior of the shell base.

6. The boot as defined by claim 1 wherein one end of said pressurization means is positioned on the external lateral portion of the boot and the other end of said pressurization means is moveably positioned at a location generally in the vicinity of the somital line of the foot and at the top of the foot, whereby the internal surface of the foot is pressed against the lateral internal wall of said boot.

7. The boot as defined by claim 1 wherein said pressurization means is positioned to extend from the internal lateral side wall of the boot to a moveable position at the general vicinity of the somital line of the foot at the top of the foot, whereby the external surface of the foot is pressed against the lateral external wall of the boot.

8. The boot as defined by claim 1 wherein said pressurization means has its upper end positioned over the top portion of the area in which the foot is to be inserted, said upper end being translationally moveable along a direction generally transverse to the longitudinal axis of the shell base, while the lower end of said pressurization means is fixed along the rim of the inner sole.

9. The boot as defined by claim 1 wherein said pressurization means comprises a cable.

10. The boot as defined in claim 1 wherein said pressurization means comprises a strap.

11. The boot as defined by claim 1 wherein said pressurization means comprises a flexible blade.

12. The boot as defined by claim 1 wherein said pressurization means comprises an element which when subjected to compression exerts pressure on said support element.

13. The boot as defined by claim 12 wherein said pressurization means comprises a wedge of elastic material which, upon compression, exerts force on said support element.

14. The boot as defined by claim 12 wherein said pressurization means is a sack of viscoelastic material.

15. The boot as defined by claim 1 wherein said adjustment means comprises a nut, said pressurization means being secured at one of its ends to said nut.

16. The boot as defined by claim 15 wherein said nut is generally positioned above the upper portion of the zone adapted to receive said foot, and wherein said adjustment means further comprises a threaded bolt, said nut being adapted to move translationally along said threaded bolt, said threaded bolt having a handle attached thereto to permit rotation of said bolt to move said nut, thereby tightening or loosening said pressurization means.

17. The boot as defined by claim 1 wherein said adjustment means comprises a nut and a threaded bolt, and wherein said pressurization means is integral with said bolt at its upper end, said bolt being adapted to move said pressurization means translationally along said threaded bolt, said threaded bolt having a handle attached thereto to permit rotation of said bolt to move said nut, thereby tightening or loosening said pressurization means.

18. The boot as defined by claim 1 wherein said pressurization means comprises a traction cable forming an uninterrupted stirrup around the upper portion of said foot, said cable being adapted to be tightened or loosened, by said adjustment means.

19. The boot as defined by claim 18 wherein said stirrup extends from the rear lower portion of said shell base upwardly around the instep portion of the boot, said stirrup extending over the exterior portion of said shell over a portion of its circumference and extending directly on said support element over the remaining portion of its circumference.

20. The boot as defined by claim 19 wherein said shell base comprises openings provided on each of the lateral sides of said boot at points situated at different heights on said boot.

21. The boot as defined by claim 20 wherein said openings are positioned to allow for said stirrup to come in direct contact with said support element while otherwise permitting said stirrup to extend over the exterior portion of said shell base over the remaining portions of its circumference.

22. The boot as defined by claim 21 wherein said stirrup is associated with said adjustment means, said adjustment means comprising a latching mechanism adapted to tighten or loosen the force exerted by said stirrup on said support element.

23. The boot as defined by claim 21 wherein said stirrup directly contacts said support element to exert pressure thereon, while otherwise extending over the exterior portion of said shell base.

24. The boot as defined by claim 1 wherein said support element acts as a distribution plate adapted to distribute the force exerted by said pressurization means on said foot.

25. The boot as defined by claim 1, wherein said boot comprises a spoiler journalled on said shell base and wherein said pressurization means extends to said spoiler.

26. The boot defined by claim 1 wherein at least a portion of said pressurization means further comprises a flexible arch having first and second ends, wherein said first end is positioned in the vicinity of one of the lateral edges of said inner sole, while said second end is positioned in the vicinity of the somital line at a location corresponding to the upper portion of the foot, whereby a cord is defined between the two ends of said arch which is oblique with respect to the plane partially containing one of the lateral walls of the boot, said cord extending transversely to the longitudinal axis of the interior of said shell base.

27. The boot defined by claim 26 wherein one of said first and second ends of said arch is fixed with respect to the other of said first and second ends of said arch and wherein said other of said first and second ends of said arch is attached to said adjustment means.

28. The boot defined by claim 27 wherein said boot comprises only one arch.

* * * * *

UNITED STATES PATENT AND TRADEMARK OFFICE

CERTIFICATE OF CORRECTION

PATENT NO. : 4,557,061

DATED : December 10, 1985

INVENTOR(S) : Gerard GRAILLAT et al.

It is certified that error appears in the above-identified patent and that said Letters Patent is hereby corrected as shown below:

In Fig. 5, please change reference numeral "3'''" to ---3'''---.

Column 3, line 17, change "t" to ---to---.

Column 5, line 9, numeral "4" should be in bold and not Roman letters.

Column 7, line 1, change "elements" to ---element---.

Column 7, line 14, after "36" add ---increases in volume and consequently exerts a---.

Column 4, line 44, delete "is".

Column 4, line 52, change "uniformally" to ---uniformly---.

Column 4, line 66, change "movable" to ---moveable---.

Column 5, line 34, change "movable" to ---moveable---.

Column 5, line 37, change "affect" to ---effect---.

UNITED STATES PATENT AND TRADEMARK OFFICE

CERTIFICATE OF CORRECTION

PATENT NO. : 4,557,061

DATED : December 10, 1985

INVENTOR(S) : Gerard GRAILLAT et al.

It is certified that error appears in the above-identified patent and that said Letters Patent is hereby corrected as shown below:

Column 6, line 49, change "12" to -- 13 --.

Column 6, line 50, delete "prime"

Column 7, line 57, change "the" to -- to --.

Signed and Sealed this

*Twenty-second* Day of *July 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,557,061

DATED : December 10, 1985

INVENTOR(S) : Gerard GRAILLAT et al.

It is certified that error appears in the above-identified patent and that said Letters Patent is hereby corrected as shown below:

In Fig. 5, please change reference numeral "3'''" to ---3'''---
In Column 3, line 17, change "t" to ---to---.
In Column 4, line 44, delete "is".
In Column 4, line 52, change "uniformally" to ---uniformly---.
In Column 4, line 66, change "movable" to ---moveable---.
In Column 5, line 9, numeral "4" should be in bold and not Roman letters.
In Column 5, line 25, insert --- - --- between "nut and "bolt".
In Column 5, line 34, change "movable" to ---moveable---.
In Column 5, line 37, change "affect" to ---effect---.
In Column 6, line 10, change "act" to ---acts---.
In Column 6, line 49, change "12" to ---13---.
In Column 6, line 50, delete "prime".
In Column 7, line 1, change "elements" to ---element---.
In Column 7, line 14, after "36" add ---increases in volume and consequently exerts a---.
In Column 7, line 57, change "the" to ---to---.

Signed and Sealed this

Eleventh Day of November, 1986

*Attest:*

DONALD J. QUIGG

*Attesting Officer* *Commissioner of Patents and Trademarks*